United States Patent [19]

McFarlan

[11] 4,010,624

[45] Mar. 8, 1977

[54] AIR CONDITIONING SYSTEM

[76] Inventor: Alden Irving McFarlan, 691 Dorian Road, Westfield, N.J.

[22] Filed: Nov. 25, 1974

[21] Appl. No.: 526,815

Related U.S. Application Data

[60] Division of Ser. No. 436,355, Jan. 24, 1974, Pat. No. 3,850,007, which is a continuation of Ser. No. 260,211, June 6, 1972, abandoned.

[52] U.S. Cl. ..... 62/159; 62/279; 62/305; 62/325

[51] Int. Cl.[2] ..... F25B 29/00

[58] Field of Search ..... 62/98, 99, 159, 279, 62/305, 325; 165/22

[56] References Cited

UNITED STATES PATENTS

| | | | |
|---|---|---|---|
| 2,212,356 | 8/1940 | Shure | 62/305 X |
| 2,296,997 | 9/1942 | Knoy | 62/305 X |
| 2,297,928 | 10/1942 | Wilson | 62/305 |
| 2,797,068 | 6/1957 | McFarlan | 62/435 X |
| 2,935,857 | 5/1960 | McFarlan | 62/435 X |
| 3,026,690 | 3/1962 | Deverall | 62/305 |
| 3,067,587 | 12/1962 | McFarlan | 62/159 |
| 3,628,600 | 12/1971 | McFarlan | 165/22 |

*Primary Examiner*—Ronald C. Capossela
*Attorney, Agent, or Firm*—Harold L. Stults

[57] ABSTRACT

Air conditioning systems particularly suitable for large buildings located where water is not available for evaporative cooling to provide a heat sink. The condensate from the conditioned air is collected at the cooling and dehumidifying coils and is used as make-up water for one or more evaporative cooling towers which act as the heat sink. One of the cooling towers provides cooling solely by conduction with outside air. Air is exhausted from the conditioned space through one of the cooling towers so as to utilize the evaporation of the condensate in the low temperature and low relative humidity air. The invention also provides for improved operation and efficiency in systems without regard to utilizing condensate for evaporative cooling.

11 Claims, 3 Drawing Figures

AIR CONDITIONING SYSTEM

This is a division of Ser. No. 436,355, filed Jan. 24, 1974, now U.S. Pat. No. 3,850,007 which is a continuation of Ser. No. 260,211 filed June 6, 1972, now abandoned.

This invention relates to air conditioning, and particularly improving the control and efficiency of air conditioning systems and methods of operation for buildings, and to such systems where water is not available for use in evaporative cooling towers.

An object of this invention is to provide improved air conditioning systems and methods. Another object is to provide such systems for localites where water is scarce or unavailable for use in cooling towers. In such localities, small air conditioning units utilize air cooling and the absence of water is of no significance. Also, a large building may be cooled by a central air conditioning system having "dry cooling towers" through which water or a glycol solution or another heat exchange liquid is circulated in closed pipes or coils so as to be cooled by conduction with the air, and then circulated from the cooling tower through the condensers of refrigeration systems. However, such cooling towers are expensive and very large and heavy so that they require excessive amounts of space and produce design and construction problems. It is an object of the present invention to provide improved air conditioning systems which operate without a water supply and with a high degree of efficiency.

IN THE DRAWINGS

Figure 1:
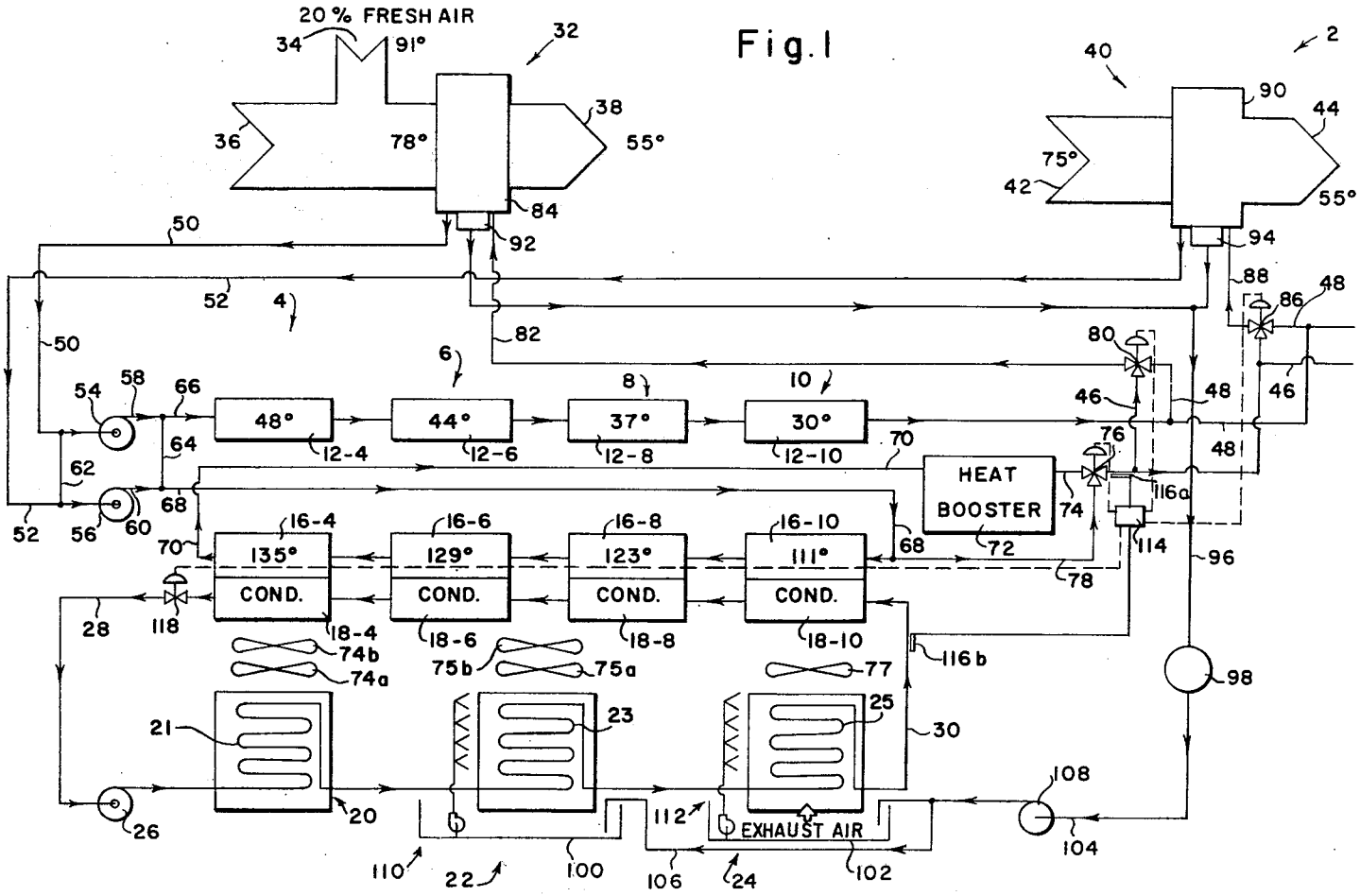
FIG. 1 is a schematic representation of one embodiment of the invention with refrigeration units having double condensers with a closed flow circuit for the cooling liquid through cooling towers.

Referring to FIG. 1, an air conditioning system 2 has a central station at which there are four refrigeration units 4, 6, 8 and 10. Each of these refrigeration units has the following identical components each of which is identified by a suffix number corresponding to the number of its unit: a chiller or evaporator-chiller 12, a compressor (not shown), a heat pump condenser section 16, a cooling liquid condenser section 18 and other standard components which are not shown, including an expansion valve and controls. Three cooling towers 20, 22 and 24 provide a very satisfactory heat sink for the system, and have coils 21, 23 and 25, respectively. A cooling liquid, i.e., a water-glycol solution, is circulated by a pump 26 through a closed circuit, with the flow in series through condenser sections 18-10, 18-8, 18-6 and 18-4, a line 28, a pump 26, coils 21, 23 and 25, and a line 30.

System 2 is of the "Three Pipe Envelope" type with a plurality of air-treating units, of which units 32 and 40 are illustrative. Unit 32 receives fresh air at inlet 34 and return air at inlet 36 and supplies conditioned air at outlet 38 for interior zones of the building. Unit 40 receives return air at inlet 42 and supplies conditioned air at outlet 44 for the periphrey of envelope of the building. Hot water is supplied through a common supply line 46 and chilled water is supplied through the common supply line 48, and there is a "common return line" formed by lines 50 and 52 extending from units 32 and 40, respectively, to a pair of pumps 54 and 56 which discharge into lines 58 and 60, respectively. A line 62 connects lines 50 and 52, and a line 64 connects lines 58 and 60. A line 66 which is in general alignment with line 58 extends from line 64 to chiller 12, and a line 68 which is in general alignment with line 60 extends from line 64 to condenser section 16-10. Hence, pump 54 tends to draw return water from line 50 and to discharge it to line 58 and to line 66, and pump 56 tends to draw return water from line 52 and to discharge it to line 60 and to line 68. But either pump can draw return water from either of lines 50 or 52 and can discharge water through its line 58 or 60 and thence directly, or through line 64, through either of lines 66 or 68.

The stream of water to be heated passes in series through condenser sections 16-10, 16-8 and 16-6 and 16-4 and thence through a line 70, a booster heater 72, a line 74 and a three-way valve 76 to the hot water line 46. A bypass line 78 extends from line 68 to valve 76, so that valve 76 can pass hot water from condenser section 16-4 to line 46, or that valve can bypass the condenser sections with all or part of the water flowing to hot water line 46 being return water flowing from line 68. The stream of water flowing to the chilled water line flows in series through chillers 12-4, 12-6, 12-8 and 12-10 to line 48.

Unit 32 has an air-treating coil 84, and there is a valve 80 which is thermostatically controlled in response to the temperature of the air discharged at outlet 38 and which provides the coil 84 with hot water or chilled water from the respective lines 46 and 48, or a mixture of the two, to maintain the desired air temperature. A valve 86 acts similarly for the air-treating coil 90 of unit 40 in response to the temperature of the air discharged from outlet 44 to supply that coil with hot water or chilled water or a mixture of the two, and maintain the desired air temperature at that outlet. During "summer" operation, very acceptable operating conditions may be maintained by supplying the hot water line 46 with return water or with a mixture of return water and heated from the condenser circuit. A master controller 114 for the system regulates valve 76 to divert return water from the condenser circuit through bypass line 78 as is required.

Cooling tower 20 provides cooling for the stream of condenser cooling liquid flowing from line 28 through coil 21 by transferring heat by conduction to a large volume of air which is circulated by a blower 74. Coil 21 has fins and no water is added for evaporation, and cooling towers 22 and 25 are evaporative cooling towers and their coils 23 and 25 also have fins. A blower 75 circulates a stream of outside air through tower 22 so that the tower combines the action of outside air and evaporative cooling. As indicative above, the system draws in outside air through inlet 34 of unit 32, and a blower 77 discharges a corresponding amount of air from the conditioned space through cooling tower 24 so that the tower utilizes evaporative cooling with the exhaust air which is generally at a low temperature and a low relative humidity.

The water for the evaporative cooling towers 22 and 24 is condensate which is removed from the air by units 32 and 40. The condensate is collected in pans 92 and 94, respectively, beneath coils 84 and 90, and flows through condensate drain lines 96 to a tank 98. Cooling towers 22 and 24 have sump tanks 100 and 102, respectively, to which the condensate is delivered from tank 98 through lines 104 and 106 by a pump 108. A sump pump and spray unit 110 in cooling tower 22 circulates the condensate through a spraying cycle over coil 23, and a similar unit 112 provides the same spray cycle circulation over coil 25 of cooling tower 24.

The entire system is controlled in accordance with my prior U.S. Pat. No. 3,628,600 by a master controller 114 which has thermostat bulbs **116-*a* and 116-*b* positioned respectively to sense the temperature of the hot water in line 46 and of the condenser cooling liquid in the return line 30 from the cooling tower. Also, a normally-open throttling valve 118 is positioned in line 28 at the discharge side of condenser section 18-4. When desirable valve 118** is partially closed by the master controller to limit the flow of condenser cooling liquid through the cooling towers. As will be explained below, that provides the system with characteristics which materially simplify and improve the operation of the system.

The flow of the stream of chilled water through the evaporator-chillers 12 of the four refrigeration units is counter-current to the flow through the condenser sections 16 and 18 of those units. Hence, the highest temperature water being cooled is in the chiller for refrigeration unit 4, and its condenser sections provide the final heating step for the stream of hot water and also for the stream of condenser cooling liquid. That reverse staging of the evaporator-chillers and the condensers utilizes the refrigeration units to provide maximum cooling for the chilled water and maximum heating for the hot water and the condenser cooling liquid. The present invention permits obtaining special advantages from the low temperature chilled water and the high temperature hot water and condenser cooling liquid. As indicated above, the condenser cooling liquid is first subjected to cooling solely by direct conduction with a large volume of outside air in cooling tower 20. It then passes to cooling tower 22 where it is subjected to evaporate cooling utilizing outside air which is at a lower temperature level than in cooling tower 20 where the outside air alone is used. The final cooling step in cooling tower 24 is at a still lower temperature level because the evaporation in the low temperture and low relative humidity air produces a greatly reduced cooling temperature range. For example, assume that the outside air is at 91° F dry bulb temperature and 75° F wet bulb temperature and that the condenser cooling liquid in line 28 is at a temperature of 125° F and drops to 105° F in cooling tower 20, to 95° F in cooling tower 22 and then to 90° F in cooling tower 24.

It is thus seen that a major portion of the heat is dissipated to the dry outside air and that the two stages of evaporative cooling are then used to provide an extra drop in the return water temperature. That gives an unusually high temperature gradient across the cooling towers, and of course, across the condensers. Furthermore, that gradient may be increased by partially closing throttling valve 118 so to reduce the rate of flow through the condensers and cause the smaller amount of liquid to carry away the condenser heat at a higher temperature level. The master controller 114 is programmed to operate throttling valve 118 so as to provide the desired controlled dissipation of heat and to insure the proper temperatures of chilled water and hot water in lines 48 and 46 at all times.

During periods when cooling only is required, the temperature of the return liquid from the cooling towers tends to fall when there is a drop in the outside air temperature. If that liquid temperature drops too low it may cause inefficient or unsatisfactory operation of the refrigeration units. For example, an excessively low condenser temperature will cause the condensed liquid refrigerant to remain in the condenser so that its evaporator is "starved" of refrigerant. Hence, when master controller 114 calls for throttling valve 118 to partially close to reduce the flow of liquid through the cooling towers, as explained above, an excessive drop in the temperture of the liquid in line 30 causes the master controller to "override" the valve closing signal and the valve is fully opened. That increases the flow of liquid through the cooling tower circuit and raises the temperature of the liquid in line 30, with a resultant rise in the temperature level in the condensers, and corrects any difficulty in the operation. The master controller is also programmed to reduce or stop the flow of air through cooling towers 20 and 22 by steps to maintain the desired temperature of hot water in line 46, and to aid in providing an acceptable temperature for the return liquid in line 30. That involves stopping the blowers **74*a* and 74*b* and 75*a* and 75*b* in accordance with a predetermined sequence. That sequential stopping of the blowers produces a stepped reduction in the rate at which heat is dissipated in the towers. Hence, the master controller can regulate the rate of heat dissipation accurately over a wide range and can maintain the precise temperatures desired for the hot water and the chilled water in lines 46 and 48. Throttling valve 118 does not close completely so that there is always a stream of liquid flowing through the cooling tower circuit. The invention also contemplates that where it is feasible to do so, the cooling towers may have bypass lines with control valves by which the master controller bypasses a portion of the liquid around the cooling tower as an alternative to the use of throttling valve 118.** It is thus seen that the cooling towers provide a very satisfactory heat sink with a wide range for the dissipation of heat, and that they also cooperate with the other components in the performance of the improved operation of the entire system.

Figure 2:
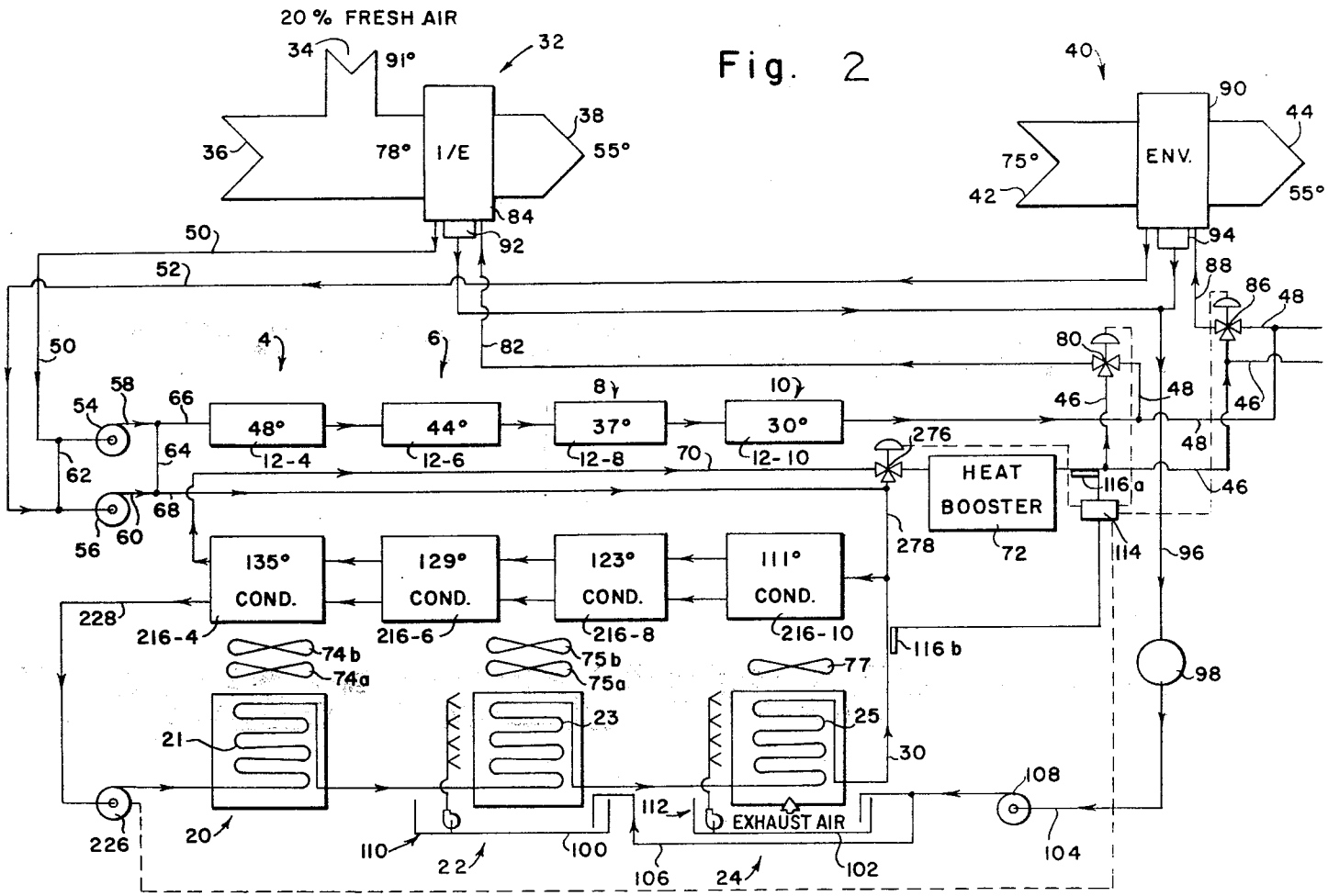
FIG. 2 is a schematic representation of another embodiment of the invention utilizing the heat transfer liquid as the cooling liquid flowing through the closed circuit of the towers.

The system of FIG. 2 is similar to the system of FIG. 1, and differs therefrom only as will be explained below. Each of the refrigeration units has only one condenser section 216 and water from the heating and cooling system is used in the cooling tower circuit. A variable speed water-circulating pump 226 in line 228 replaces valve 118 and pump 26 of FIG. 1, and draws water from the condenser circuit and directs it through the cooling tower circuit. The speed of pump 226 is controlled so that it acts in the manner of throttling valve 118 in FIG. 1 to provide means and a method for controlling the rate of flow of the liquid through the cooling tower circuit. Under high heat load conditions, pump 226 suplies the maximum flow through the cooling tower circuit, but its speed is reduced when it is desirable to circulate a smaller quantity of water. Such a reduction raises the temperature of the water flowing from the condensers so as to provide the desired temperature of the hot water in line 46.

A bypass line 278 is connected to line 70 from the booster 72 through a bypass valve 276 that replaces the bypass line 78 and valve 76 downstream from the heat booster in the system of FIG. 1. As illustrative of the control program of the master controller, assume that there is a dominant heat-dissipation or cooling load condition, the controller acts in response to a series of small progressive rises in the temperature of the hot water to initiate corrective action involving the following steps in sequence:

1. The heat booster is throttled;
2. The heat booster is turned off;
3. Pump 226 is started and operates at a speed to maintain a temperature of water in line 30 below 90° F;
4. Valve 276 is opened gradually to bypass return water from line 68 to line 70 supplying the hot water line 46. The master controller also responds to a need for minimum water temperature to reduce the rate of water flow through the cooling tower circuit, and to an excessive drop in the temperature of the water in line 30 to increase that flow.

Figure 3:
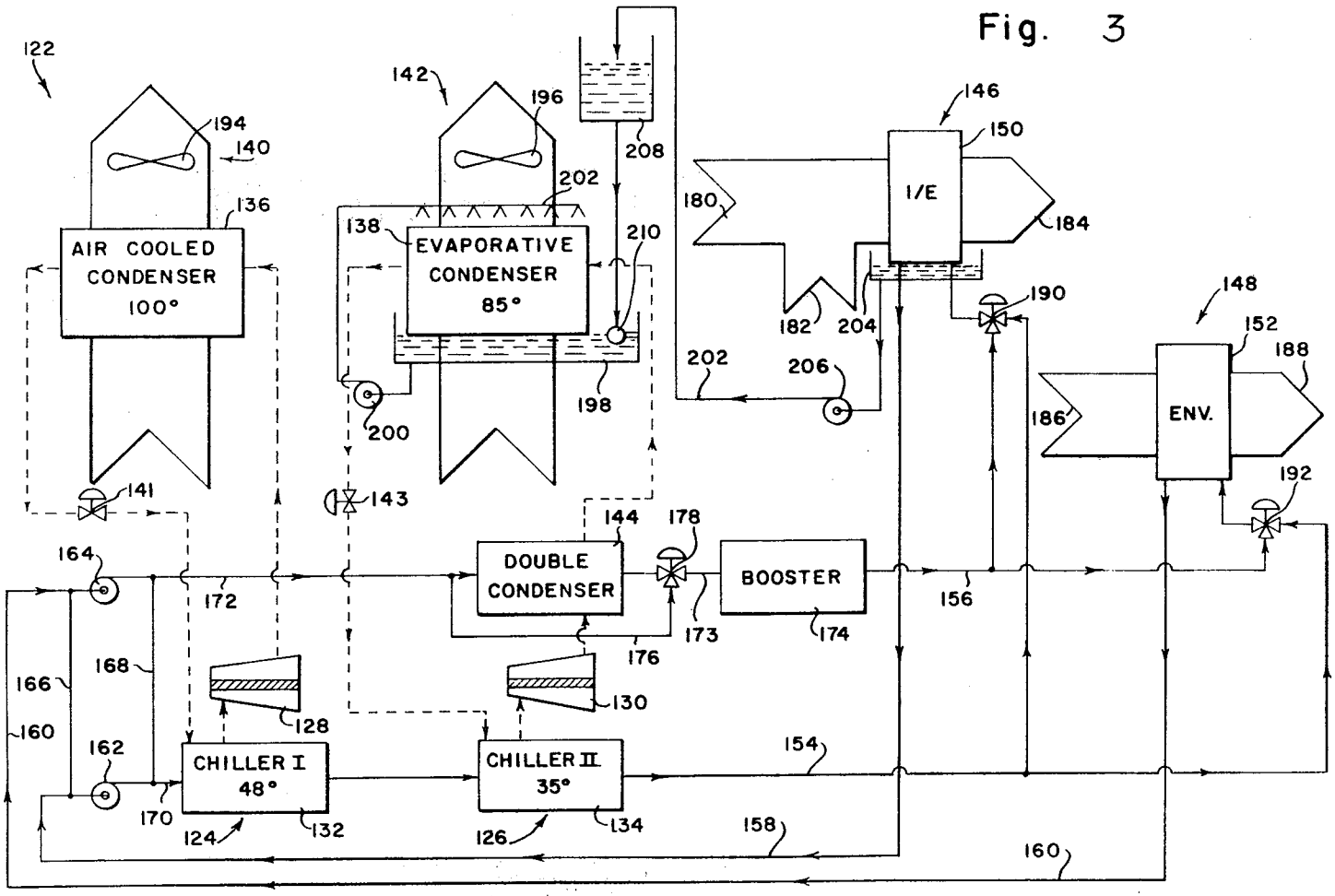
FIG. 3 is a schematic representation of another embodiment of the invention having tower condensers.

In the embodiment of FIG. 3, the system also utilizes the condensate to provide evaporative cooling in a cooling tower and the discussion above of the construction and operation of the embodiment of FIG. 1 also applies to FIG. 2 to the extent that it is applicable. An air conditioning system 122 has two refrigeration units 124 and 126 provided respectively, with: screw-type compressors 128 and 130; evaporator-chillers 132 and 134; condensers 136 and 138 in cooling towers 140 and 142, respectively; and, expansion valves 141 and 143. Refrigeration unit 126 also has a second condenser section 144 to which the compressed refrigerant flows from compressor 130 and from which it passes to condenser 138. Air conditioning system 122 includes a plurality of air-treating units, illustratively, 146 and 148 having air-treating coils 150 and 152, respectively, and the system is a "Three Pipe System" which includes a chilled water supply line 154, a hot water supply line 156, and a return line represented by lines 158 and 160. Lines 158 and 160 are connected to a pair or pumps 162 and 164 and there are interconnecting lines 166 and 168 on the inlet and outlet sides of the pumps, respectively, so that either pump may draw water from either of lines 158 and 160. However, pump 164 tends to draw return water from line 160 and to discharge it to a line 172 and thence to line 156, and pump 162 tends to draw return water from line 158 and to discharge it to a line 170 and thence to line 150. Hence, lines 158 and 160, 166 and 168 and the two pumps provide a "common return line" for all of the water flowing from coils 150 and 152.

Water flows to chilled water line 160 through line 170 and thence through chillers 132 and 134 in series, and water flows to hot water line 158 through line 172 and thence through condenser section 144, a line 173 and a booster heater 174.

A bypass line 176 extends around condenser section 144 to valve 178 so that water can be supplied from line 172 to line 173 and thence to line 156 without flowing through the condenser section. Air-treating unit 146 receives a controlled mixture of outside air and return air through inlets 180 and 182, respectively, and the air is discharged at outlet 184 and passes to the interior zones in the building. Air-treating unit 148 receives only return air at 186 and the air is discharged at 188 to the building periphrey or envelope. Unit 146 has a valve 190 which is thermostatically controlled in response to the temperature of the air discharged at outlet 184 to provide coil 150 with hot water or chilled water from the respective lines 156 and 154, or a mixture of the two. A valve 192 acts similarly for its coil 152 in response to the temperature of the air discharged from outlet 188 to supply hot water or chilled water or a mixture of the two from lines 154 and 156.

Cooling tower 140 provides cooling for its condenser 136 by transferring the heat by conduction to a large volume of outside air which is circulated by blower 194 and without the addition of water for evaporation. However, cooling tower 142 is an evaporative condenser cooling tower with a blower 196, a sump tank 198, and a water-circulating pump 200. The water for cooling tower 142 is condensate from coil 150 of unit 146 which is collected in a drain pan 204 and delivered by a pump 206 through a line 202 to a storage tank 208 from which it is fed to sump tank 198 by gravity under the control of a float valve 210. Hence, the condenser 136 of refrigeration unit 124 is air cooled, while condenser 138 of refrigeration unit 126 is cooled by air with the evaporative cooling of the condensate.

In each of the illustrative embodiments the cooling towers act as a staged heat sink with the first stage being a dry tower and with a second stage which is an evaporative tower in which condensate is used. In the embodiment of FIGS. 1 and 2 the third cooling tower stage utilizes exhaust air to provide additional advantages discussed above. The invention contemplates that exhaust air can be used in the second stage tower of the embodiment of FIG. 3.

It should be noted that the condensate from the air cooling coils of air conditioning systems is ideal for use in evaporative cooling in the cooling towers. Such condensate is free of the carbonates and other chemicals which occur in ground water in many localities. Such chemicals tend to accumulate in the tower and interfere with the heat transfer, and create frequent and serious service problems. In some localities the problems caused by such accumulations has caused the fins to be omitted from the coils in towers so that bare coils are used. With the present invention, the use of the "distilled" condensate permits the cooling towers to have the most efficient fined coils with the resultant savings and freedom from service problems.

It is understood that the invention contemplates other modifications and embodiments within the scope of the claims.

What is claimed is:

1. In an air conditioning system for a conditioned space, the combination of, refrigeration means comprising a plurality of refrigeration units, a first heat sink means for said refrigeration means with air-circulation means to effect cooling solely by the circulation of air in heat exchange relationship therewith, a second heat sink means which includes a heat sink cooling zone which provides evaporative cooling by the circulation of air and the evaporation of water, each of said refrigeration units having an evaporator-chiller and other elements forming an operating unit, air cooling means including an air-cooling coil through which a cooling liquid may flow to said conditioned space to cool and dehumidity air and thereby produce condensate, means to circulate a cooling liquid in series through said evaporator-chillers and thence through said air-cooling coil, and means to supply said condensate to said heat-sink cooling zone of said second heat sink means.

2. An air conditioning system as described in claim 1 wherein each of said heat sink means comprises a cooling tower having a liquid cooling coil, and wherein each of said refrigeration units has a liquid cooled condenser, and means to circulate cooling liquid through said condensers and thence through said liquid cooling coil of said first heat sink means and thence through said liquid cooling coil of said second heat sink means.

3. A system as described in claim 2 which includes means to pass a stream of outside air through said system into said conditioned space and to discharge a stream of air from said conditioned space through said second cooling tower whereby condensate is evaporated into a stream of air which is being exhausted from the system.

4. An air conditioning system as described in claim 1 wherein said second heat sink means is an evaporative cooling tower having a sump tank, a storage tank for said condensate, and a pump for circulating said condensate from said sump tank to promote evaporative cooling in said cooling tower.

5. An air conditioning system as described in claim 1 which includes means to circulate a heat-transfer liquid through said refrigeration units to discharge heat from said refrigeration units, and control means to control the supplying of said cooling liquid and the heated liquid to said air-coil whereby air is supplied to said conditioned space at a controlled temperature.

6. An air conditioning system as described in claim 5 wherein said refrigeration units have condensers through which said heat-transfer liquid flows when being heated, and means to bypass all or part of a stream of said heat-exchange liquid around said condensers.

7. In an air conditioning system for supplying conditioned air to space including a plurality of refrigeration units which provide staged cooling and wherein the refrigeration unit performing the final cooling stage has a condenser temperature which is higher than the condenser temperature of the other refrigeration unit or units and wherein air is cooled and dehumidified to produce condensate, the combination of, heat sink means for disposing of the heat from said refrigeration units which includes a first cooling tower and a second cooling tower, said first cooling tower having a cooling coil and blower means to pass a stream of outside air in heat exchange relationship therewith to remove heat from said coil solely by conduction without evaporative cooling, said second cooling tower including a cooling coil in an evaporative cooling-zone and a blower to circulate air in heat exchange relationship therewith, and means to collect and supply said condensate to said cooling zone and to evaporate it to provide evaporative cooling for the coil of said second cooling tower, wherein said coil of said first cooling tower receives fluid to be cooled at a higher temperature than the fluid to be cooled which is received by the coil of said second cooling tower.

8. An air conditioning system as described in claim 7 wherein each of said cooling towers is a condenser tower including a condenser section of a refrigeration unit and said fluid is refrigerant.

9. An air conditioning system as described in claim 7 wherein said refrigeration units have liquid-cooled condenser sections and wherein a stream of cooling liquid flows through said condenser sections in series countercurrent flow relationship with respect to the series flow through the cooling stages performed by the respective refrigeration units, and wherein said stream of said cooling liquid flows in series through the respective coils of said first and second cooling towers.

10. An air conditioning system as described in claim 7 wherein said refrigeration units have liquid cooled condenser sections through which cooling liquid flows, and wherein said cooling liquid constitutes said liquid to be cooled by said cooling towers, and means to vary the amount of cooling liquid flowing through said coils of said cooling towers.

11. An air conditioning system as described in claim 10 which includes means to condition outside air and to supply it to an enclosure, a third cooling tower having a coil through which said cooling liquid flows after passing through the coils of said first cooling tower and said second cooling tower in series, means to evaporate a portion of said condensate to provide evaporative cooling for the coil of said third cooling tower in the presence of air exhausted from said enclosure.

* * * * *